US005508680A

United States Patent [19]

Larsen et al.

[11] Patent Number: 5,508,680

[45] Date of Patent: Apr. 16, 1996

[54] SOLDERLESS SOLENOID ASSEMBLY FOR USE IN AN ELECTRICAL SIGNALING DEVICE

[75] Inventors: Stephen Larsen, Fayetteville, N.C.; Karen A. Hudson, Church Hill, Tenn.

[73] Assignee: Fasco Consumer Products, Inc., Fayetteville, N.C.

[21] Appl. No.: 80,701

[22] Filed: Jun. 21, 1993

[51] Int. Cl.[6] ..... G10K 1/00

[52] U.S. Cl. ..... 340/392.4; 340/391.1; 340/396.1; 340/388.1; 340/392.1

[58] Field of Search ..... 340/392.4, 391.1, 340/396.1, 392.1, 388.5, 388.1

[56] References Cited

U.S. PATENT DOCUMENTS

| | | | |
|---|---|---|---|
| 1,349,400 | 8/1920 | Wende . | |
| 1,546,615 | 7/1925 | Boehm . | |
| 1,691,295 | 11/1928 | Little . | |
| 2,152,300 | 3/1939 | Bossard . | |
| 2,247,641 | 7/1941 | Pearl . | |
| 2,466,640 | 4/1949 | Gardes | 340/392.4 |
| 3,375,803 | 4/1968 | Doggart | 340/392.5 |
| 4,175,262 | 11/1979 | Harakawa et al. | 340/391.1 |
| 4,257,036 | 3/1981 | Slavin et al. | 340/391.1 |
| 4,284,857 | 8/1981 | Slavin et al. | 340/391.1 |

FOREIGN PATENT DOCUMENTS

| | | |
|---|---|---|
| 699115 | 12/1964 | Canada . |
| 739698 | 8/1966 | Canada . |

*Primary Examiner*—Donnie L. Crosland
*Attorney, Agent, or Firm*—Lorusso & Loud

[57] ABSTRACT

A solderless solenoid assembly, preferably for use in an electrical signaling device. The solenoid assembly is formed by wrapping conductive wire around a bobbin, forming a solenoid coil. A plurality of terminal displacement slots are attached to the bobbin. The lead wires of the coil are terminated in the bobbin terminal displacement slots. Electrical connectors are placed in each of the terminal displacement slots. The entire solenoid assembly snaps into a solenoid coil support bracket. The solenoid coil support bracket is then secured to a base which is connected to an electrical signaling device.

14 Claims, 4 Drawing Sheets

SOLDERLESS SOLENOID ASSEMBLY FOR USE IN AN ELECTRICAL SIGNALING DEVICE

BACKGROUND OF THE INVENTION

1. Field of Invention

The invention relates to a solderless solenoid assembly for use in an electrical signaling device, and a method of making such an assembly.

2. Description of Prior Art

Solenoid assemblies commonly form part of electrical signaling devices used to actuate doorbells, chimes or buzzers. Solenoids used in such devices are generally formed by wrapping electrically conductive wire around a tube or sleeve of insulating material. These solenoids are commonly mounted in a machined housing or secured to a support bracket by mechanical fasteners such as screws or bolls. U.S. Pat. Nos. 1,349,400 to Wende; 1,691,295 to Little; 1,546,515 to Boehm; 2,152,300 to Bossard; 2,247,641 to Pearl; and Canadian Patent No. 739,698 depict typical solenoid mountings.

Electrical contact between the current source and the solenoid is generally established through screw or soldered connections. The art cited above, as well as Canadian Patent No. 699,115, illustrate typical methods for connecting the solenoid to the current source.

Solenoid assemblies of the prior art are difficult to manufacture and assemble because of the need for machined housings and mechanical fasteners. Further, existing solenoid assemblies require soldered electrical connections, or connection established using mechanical fasteners such as screws.

The solenoid assembly of the present invention overcomes the limitations inherent in prior art devices.

SUMMARY OF THE INVENTION

An object of the present invention is to provide an improved solenoid assembly for use in electrical signaling devices that actuate doorbells, buzzers, chimes, light signaling devices, etc.

An object of the present invention is to provide a solenoid assembly having a snap fit solenoid mounting.

Another object of the present invention is to provide solder free electrical connections between the solenoid coil and the current source.

A further object is to provide an electrical connection which eliminates the use of mechanical fasteners, i.e., screws, as a means for establishing the electrical connection between the solenoid assembly and the current source.

The above objectives are accomplished through the use of the solderless solenoid assembly of the present invention. The solderless solenoid assembly is created by wrapping conductive wire around a bobbin to form a solenoid coil. A plurality of terminal displacement slots are attached to the bobbin. The lead wires of the solenoid coil are threaded into the terminal displacement slots. Electrical connectors are placed in each of the terminal displacement slots, making electrical contact with the wire. The solderless solenoid assembly snap-fits into a solenoid coil support bracket. The solenoid coil support bracket is then secured to a base which is connected to a means for signaling.

A terminal board having contact fingers adapted to plug into the terminal displacement slots is placed in spaced relation to the solenoid assembly. When a force causes the contact fingers to plug into the terminal displacement slots, current flows to the solenoid coil.

The mounting method and the method of establishing the electrical connection overcomes the limitations inherent in the prior art. The snap-fit mounting eliminates the use of machined housing and mechanical fasteners. Further, the snap-fit mounting enhances the versatility of the solenoid assembly for use with other devices. Additionally, the solderless electrical connections simplify the manufacture and assembly of solenoid assemblies.

BRIEF DESCRIPTION OF THE DRAWINGS

FIG. 3 further illustrates a cut-away of the terminal displacement slot, showing the placement of the electrical connectors therein.

FIG. 4 further shows the contact fingers engaging the electrical connectors placed in the terminal displacement slots.

DESCRIPTION OF A PREFERRED EMBODIMENT

The present invention is an improved electrical signaling device. The electrical signaling device includes a novel solderless solenoid assembly, a base, a solenoid coil support bracket, a means for signaling and a means for actuating the means for signaling.

The preferred embodiment is now described with reference to the drawings.

Figure 1:
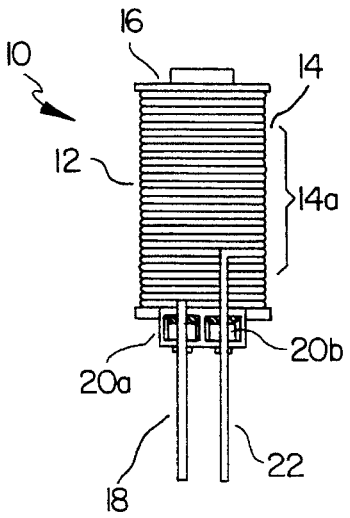
FIG. 1 is the plan view of the solenoid assembly.

FIG. 1 shows a plan view of the solderless solenoid assembly 10. The solderless solenoid assembly 10 is formed by wrapping electrically conductive wire around bobbin 16 to form a coil 14. Bobbin 16 is made of electrically insulating material. The coil 14 is used to form the solenoid coil 12. Although the invention herein described refers to a solenoid coil, a typical coil employed in electrical or electronic systems may be used to practice the invention. Hereinafter, the term solenoid coil will be used to refer to a conductive wire wrapped around a bobbin as shown in FIG. 1, as well as to the typical electric coil used by those skilled in the art.

The starting lead 18 of wire is threaded into the left terminal displacement slot 20*a* of bobbin 16. The conductive wire is wrapped around the bobbin 16 in a counterclockwise direction to generate a number of turns 14*a*. Once the desired number of turns 14*a* have been achieved, the turns 14*a* are wrapped with electrical tape to secure them in position on the bobbin 16. The finishing lead 22 of the conductive wire is threaded through the right terminal displacement slot 20*b* of bobbin 16. Both the starting lead 18 and the finishing lead 22 are cut to approximately 2" in length.

Figure 2:
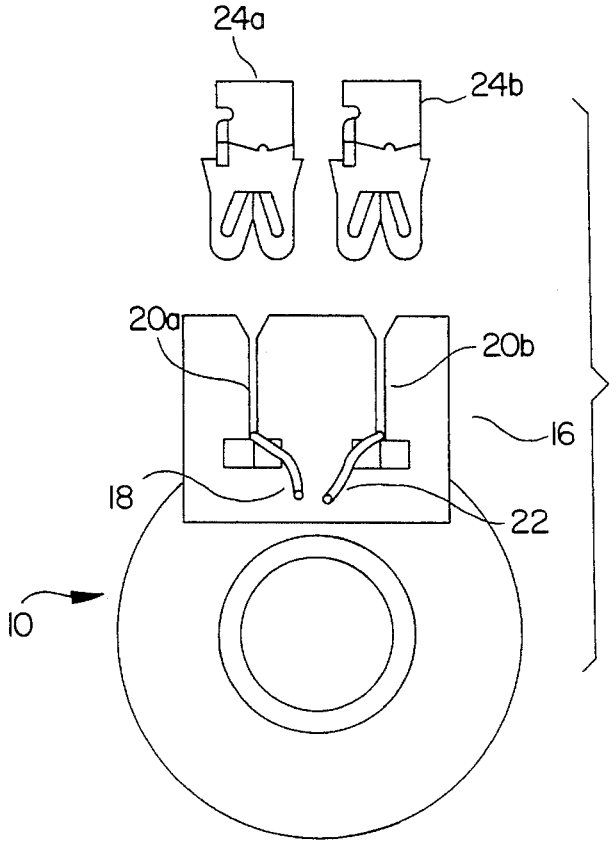
FIG. 2 shows a plan view of the bobbin and the associated electrical connectors.

FIG. 2 shows a plan view of the solderless solenoid assembly 10 and the electrical connectors 24*a* and 24*b*. The electrical connectors 24*a* and 24*b* are inserted into the respective terminal displacement slots 20*a* and 20*b* of bobbin 16. Electrical connectors 24*a* and 24*b* form an electrical connection with the starting and finishing leads 18 and 22. The resistance between the connectors 24*a* and 24*b* preferably ranges between 6–9 Ohms, but this invention should not be limited to these values.

Figure 3:
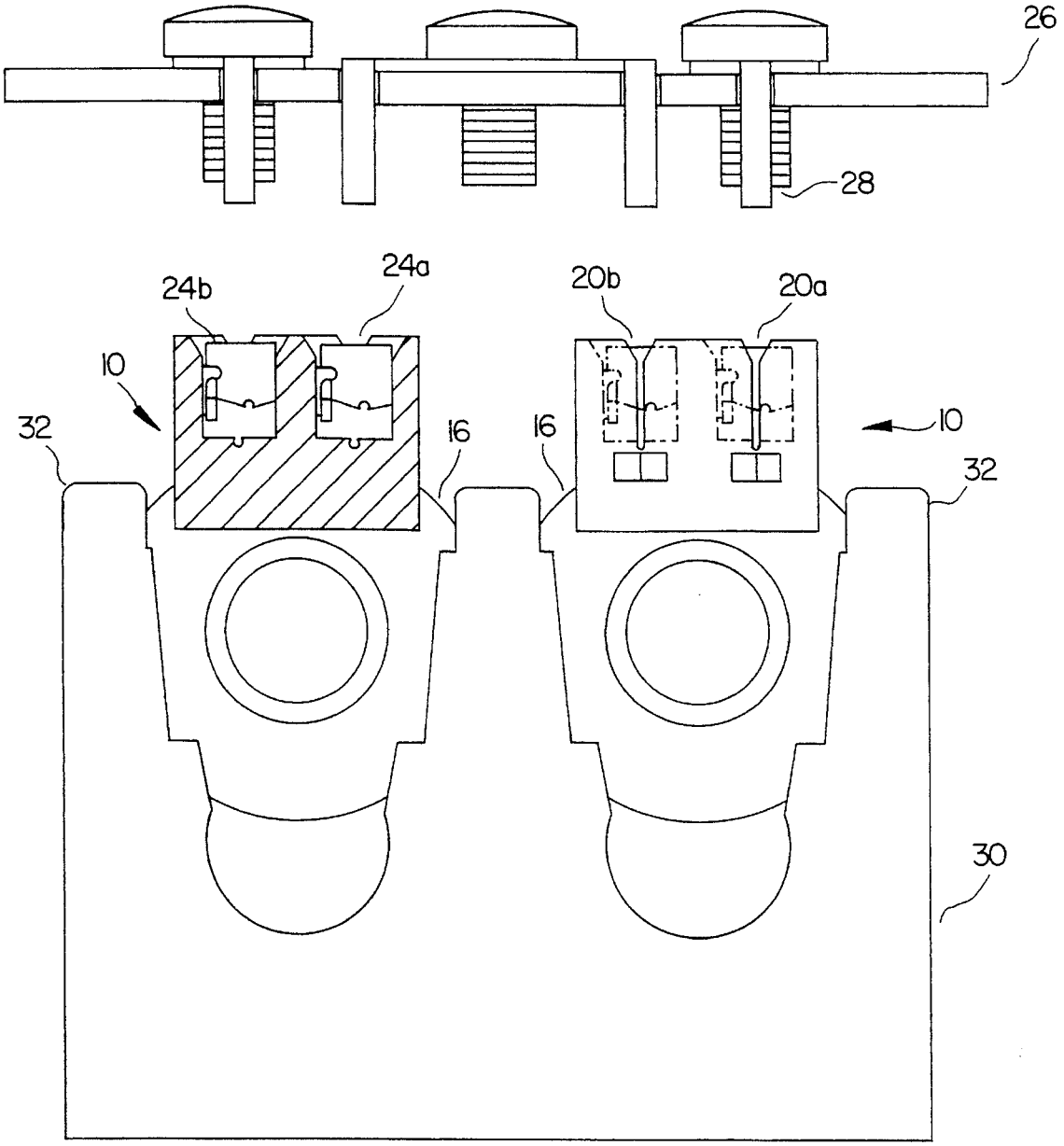
FIG. 3 shows a plan view of the solenoid assembly positioned in the solenoid coil support bracket and the placement of the terminal board with respect to the solenoid support bracket.

FIG. 3 shows the solderless solenoid assembly 10 positioned in the solenoid coil support bracket 30. This figure also illustrates the spaced relation between the terminal board 26 and the solderless solenoid assembly 10.

Figure 4:
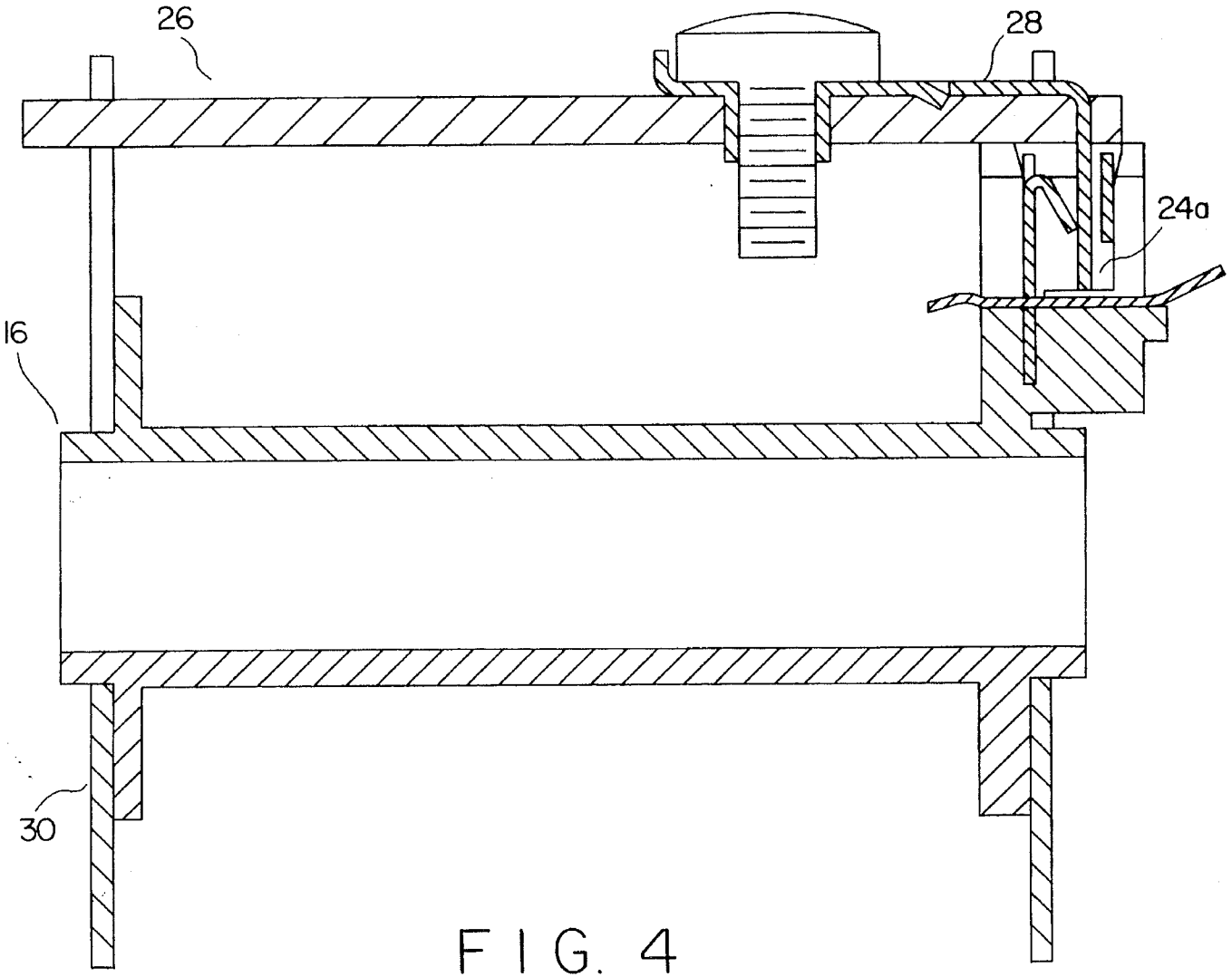
FIG. 4 is a plan view showing the position of the bobbin in the solenoid coil support bracket.

The terminal board 26 has a plurality of contact fingers 28 which engage the electrical connectors 24*a* and 24*b*. Current is allowed to flow to the solenoid coil 12 when the contact fingers 28 engage the electrical connectors 24*a* and 24*b* as shown in FIG. 4. A force exerted on terminal board 26 causes it to change position, see FIG. 4, with respect to the solderless solenoid assembly 10.

Figure 5:
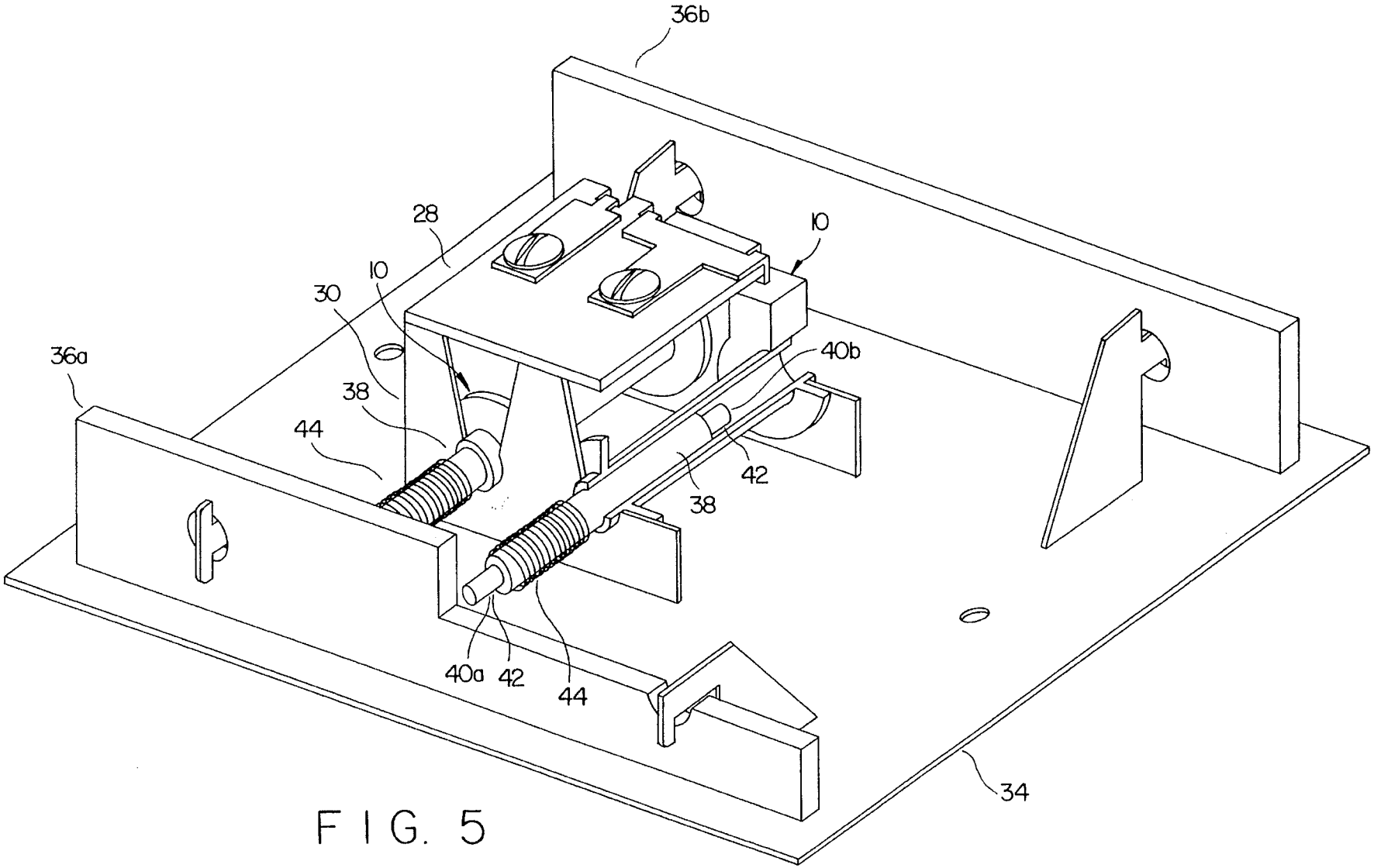
FIG. 5 is a perspective view of the solderless solenoid assembly and the solenoid coil support bracket positioned in the chime base. This figure further illustrates the position of the metallic plunger in relation to the solenoid coil and the sound emitting devices.

The terminal board 26 and the solenoid coil 12 are secured in position by solenoid coil support bracket 30. The bobbin 16 snaps into position inside the solenoid coil support bracket 30. The solenoid coil support bracket 30 has a plurality of tabs 32. Tabs 32 securely fasten the As shown in FIG. 5, the solenoid coil support bracket 30 is secured to a chime base 34 through traditional fastening means such as, but not limited to, screws or bolts. As an alternative construction, the coil support bracket 30 may be a separate structure as described herein or it may form a part of the chime base 34.

Chime base 34 houses the means for signaling. The means for signaling includes, but is not limited to, sound emitting devices, light emitting devices and vibratory devices. The means for signaling herein described refers to sound emitting devices 36*a* and 36*b*. The sound emitting devices 36*a* and 36*b* are securely fastened to the chime base 34 by traditional fastening means such as screws or other threaded fasteners.

The means for actuating the means for signaling described herein refers to a metallic plunger 38. Plunger 38 actuates sound emitting devices 36*a* and 36*b*. The metallic plunger 38 is mounted at the center of the solenoid 12. Plunger 38 has a first and second end 40*a* and 40*b*. Each end 40*a* and 40*b* of plunger 38 is covered by plastic or rubber tips 42.

The plunger 38 is propelled toward sound emitting device 36*a* by an electro-magnetic force generated by the excitation of the solenoid coil 12. The plunger 38 actuates the sound emitting devices 36*a* and 36*b* to produce preferably two sound signals.

A spring 44 is attached to the first end 40*a* of plunger 38. The spring 44 biases plunger 38 toward the second sound emitting device 36*b* while the solenoid coil 12 is in the de-energized state. When the solenoid coil 12 is energized, plunger 38 is propelled toward, and strikes, the first sound emitting device 36*a* . This motion causes the production of a first sound and the compression of the biasing spring 44. When the solenoid coil 12 is de-energized, the biasing spring 44 is decompressed. The decompression of spring 44 propels plunger 38 into the second sound emitting device 36*b*. This action causes the emission of a second sound.

The instant invention provides a novel solderless solenoid assembly which may be used in an electrical signaling device. The construction of the invention simplifies manufacturing of solenoid assemblies for use in electrical signaling devices. The solderless solenoid assembly of the present invention snap fits into position, eliminating the need for machined housings and support plates. Further, electrical connections to the solenoid are solder free and are established without the aid mechanical fasteners.

While the invention has been particularly shown and described with reference to the aforementioned embodiment, it will be understood by those skilled in the art that various changes in form and detail may be made therein without departing from the spirit and scope of the invention. Thus, any modifications to the shape, configuration and composition of the elements comprising the invention is within the scope of the present invention.

What is claimed is:

1. A combination chime base and solderless solenoid assembly comprising:

a base, a sound emitting device in cooperation with said base, a solderless solenoid assembly having a bobbin, a wire and a plurality of electrical connectors attached to said bobbin wherein said wire is wrapped around said bobbin and said solder-less solenoid assembly snap fits into said base, and a terminal board having a plurality of contact fingers, wherein a force exerted on said terminal board causes said contact fingers to electrically connect with said electrical connectors and form a solderless connection between said contact fingers and said electrical connectors thereby allowing current to flow through said solenoid assembly.

2. A combination chime base and solderless solenoid assembly according to claim 1 further comprising a plunger and a means for fastening said terminal board to said solenoid assembly such that said contact fingers are disposed in spatial relation with said electrical connectors.

3. A combination base and electrical signaling device comprising:

a base, a means for signaling, a means for activating said means for signaling having plurality of electrical connectors disposed therein, wherein said means for activating snap-fits into said base and said means for signaling is placed in spaced relation to said means for activating, and a terminal board having a plurality of contact fingers which plug into the electrical connectors of said activating means, thereby providing a solderless electrical connection for current to flow therethrough and energize said means for signaling.

4. An electrical signaling device according to claim 3 wherein said means for activating comprises, a solenoid coil further including a wire and a bobbin, said coil having multiple turns of said electrically conductive wire wrapped around said bobbin.

5. An electrical signaling device according to claim 4 further comprising, a means for fastening said terminal board to said solenoid coil such that said contact fingers are disposed in spacial relation with said electrical connectors.

6. A solderless solenoid assembly for use in an electrical signaling device comprising:

a bobbin having two terminal displacement slots, a wire, wherein said wire is wrapped around said bobbin, said wire originates at one of said two terminal displacement slots and terminates at the other said terminal displacement slot, two electrical connectors, one of said two electrical connectors attached to one of two said terminal displacement slots and the other said electrical connector attached to the other said terminal displacement slot, a metallic plunger positioned at the center of said coil, wherein said plunger is propelled by a magnetic force generated by said coil and a means for delivering current to said coil, said means having a plurality of contact fingers, said contact fingers being adapted to engage said electrical connectors thereby forming a solderless electrical connection thereto.

7. A solderless solenoid assembly according to claim 6 wherein the turns of said wire are wound counterclockwise around said bobbin to form a solenoid coil, said solenoid coil being wrapped with electrical tape after said wire wrapping to prevent the unraveling thereof during assembly.

8. A solderless solenoid assembly according to claim 6, further comprising a means for fastening said means for delivering current to said solderless solenoid assembly such that said contact fingers are disposed in spatial relation with said electrical connector

9. A solderless solenoid assembly according to claim 6 wherein a resistance between said two terminal displacement slots is between 6–9 Ohms.

10. A solderless solenoid assembly according to claim 6 wherein said plunger has a first end and a second end, wherein a spring is placed on an end of said plunger, said plunger further having plastic tips covering both the first end and second end.

11. A method of actuating an electrical signaling device comprising:

providing a signaling device;

providing a coil having a plunger disposed therein, said coil terminating in electrical connectors;

providing a terminal board for delivering current to said coil, said terminal board having contact fingers disposed in spacial relationship with said coil; delivering a force to said terminal board, said force causing said contact fingers to contact said electrical connectors, wherein said contact results in the delivery of current to said coil thereby causing said plunger to actuate said signaling device.

12. A solderless solenoid assembly for use in an electrical signaling device comprising:

a base, an electrical signaling device in cooperation with said base, a solderless solenoid assembly which snap fits into said base, said assembly further including a bobbin and a plurality of electrical connectors attached to said bobbin, said wire wrapped around said bobbin to form a starting lead and a finishing lead, wherein a force exerted on said electrical connectors causes said connectors to clutch and thereby electrically connect with said starting and finishing leads so as to make a first solderless connection, and a terminal board having a plurality of contact fingers, wherein a force exerted on said terminal board causes said contact fingers to plug into and electrically connect with said electrical connectors thereby forming a second solderless connection between said contact fingers and said electrical connectors.

13. A solderless solenoid assembly for use in an electrical signaling device according to claim 12 further comprising a means for fastening said terminal board to said solenoid assembly such that said contact fingers are disposed in spatial relation with said electrical connectors, and a plunger wherein said plunger actuates said signaling device in response to a magnetic force.

14. A solderless solenoid assembly according to claim 12 wherein a resistance of said first solderless connection as measured between the two terminal displacement slots, is in a range of about 6–9 Ohms.

* * * * *